US009470096B2

(12) United States Patent
Mishra et al.

(10) Patent No.: US 9,470,096 B2
(45) Date of Patent: Oct. 18, 2016

(54) TURBINE BUCKET WITH NOTCHED SQUEALER TIP

(75) Inventors: Niraj Kumar Mishra, Bangalore (IN); Xiuzhang James Zhang, Simpsonville, SC (US); Murugesan Seerangan, Bangalore (IN); Sachin Kumar Rai, Ranchi (IN)

(73) Assignee: General Electric Company, Schenectady, NY (US)

( * ) Notice: Subject to any disclaimer, the term of this patent is extended or adjusted under 35 U.S.C. 154(b) by 859 days.

(21) Appl. No.: 13/558,685

(22) Filed: Jul. 26, 2012

(65) Prior Publication Data

US 2014/0030102 A1 Jan. 30, 2014

(51) Int. Cl.
*F04D 29/38* (2006.01)
*F01D 5/20* (2006.01)

(52) U.S. Cl.
CPC ..... *F01D 5/20* (2013.01); *F05D 2250/23* (2013.01); *F05D 2250/231* (2013.01); *F05D 2250/232* (2013.01); *F05D 2260/202* (2013.01)

(58) Field of Classification Search
CPC ..... F01D 5/186; F01D 5/20; F01D 11/08; F01D 11/12; F01D 11/122; F01D 11/14; F05D 2240/307; F05D 2250/23; F05D 2250/231; F05D 2250/232; F05D 2260/202
USPC ..... 416/92, 97 R, 224, 228
See application file for complete search history.

(56) References Cited

U.S. PATENT DOCUMENTS

| | | | | |
|---|---|---|---|---|
| 3,854,842 | A | 12/1974 | Caudill | |
| 4,390,320 | A | 6/1983 | Eiswerth | |
| 5,261,789 | A * | 11/1993 | Butts et al. | 416/96 R |
| 5,733,102 | A | 3/1998 | Lee et al. | |
| 6,224,336 | B1 | 5/2001 | Kercher | |
| 6,224,337 | B1 | 5/2001 | Lieland et al. | |
| 6,494,678 | B1 | 12/2002 | Bunker | |
| 6,672,829 | B1 | 1/2004 | Cherry et al. | |
| 7,281,894 | B2 | 10/2007 | Lee et al. | |
| 7,607,893 | B2 | 10/2009 | Lee | |
| 7,686,578 | B2 | 3/2010 | Klasing et al. | |
| 7,704,045 | B1 | 4/2010 | Liang | |
| 8,061,987 | B1 * | 11/2011 | Liang | F01D 5/186 416/92 |
| 8,147,205 | B2 * | 4/2012 | Digard Brou De Cuissart | F01D 5/147 415/115 |
| 2003/0021684 | A1 * | 1/2003 | Downs et al. | 416/92 |
| 2005/0068525 | A1 | 3/2005 | Taverner et al. | |
| 2008/0057271 | A1 * | 3/2008 | Bunker | 428/137 |
| 2008/0175716 | A1 * | 7/2008 | Potier | F01D 5/20 416/97 R |
| 2010/0266410 | A1 | 10/2010 | Amarak et al. | |

* cited by examiner

*Primary Examiner* — Craig Kim
*Assistant Examiner* — Alexander White
(74) *Attorney, Agent, or Firm* — Dority & Manning, P.A.

(57) ABSTRACT

A turbine bucket having an airfoil is disclosed. The airfoil may include a pressure side and a suction side extending between a leading edge and a trailing edge. In addition, the airfoil may include a tip. The tip may include a tip floor and a tip wall extending outwardly from the tip floor. The tip wall may include an inner surface defining an inner perimeter of the tip wall. Moreover, a plurality of notches may be defined by the inner surface around at least a portion of the inner perimeter.

20 Claims, 5 Drawing Sheets

FIG. —1—

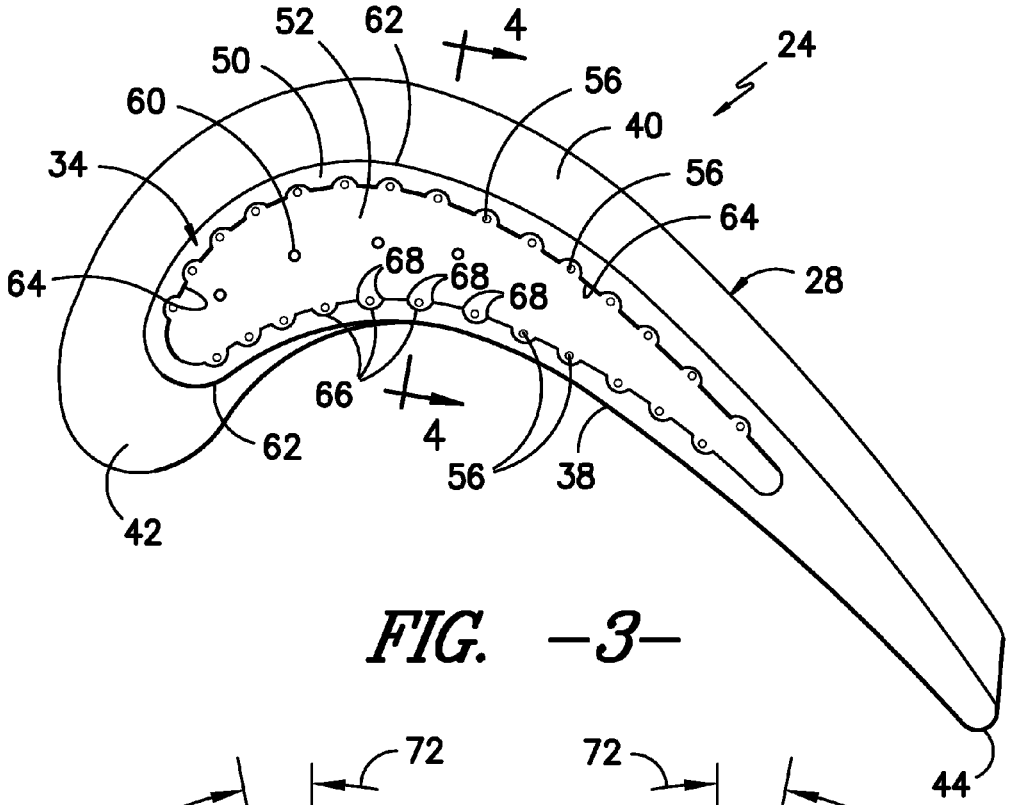
FIG. –3–
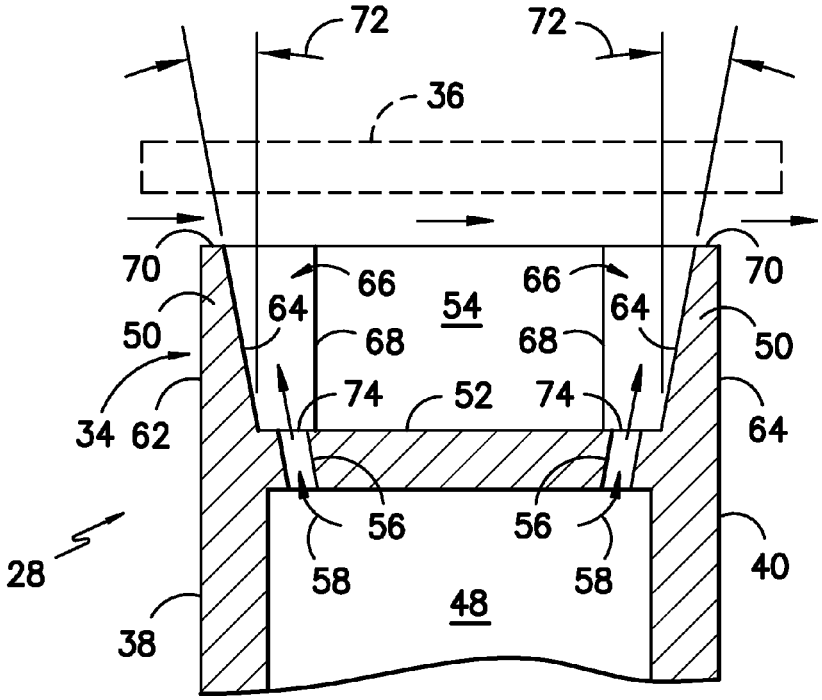
FIG. –4–

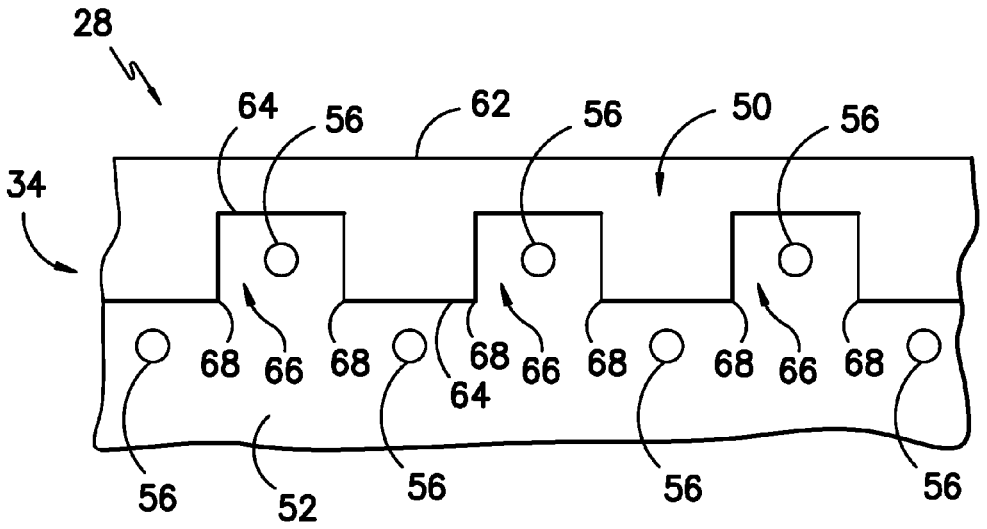
FIG. –5–
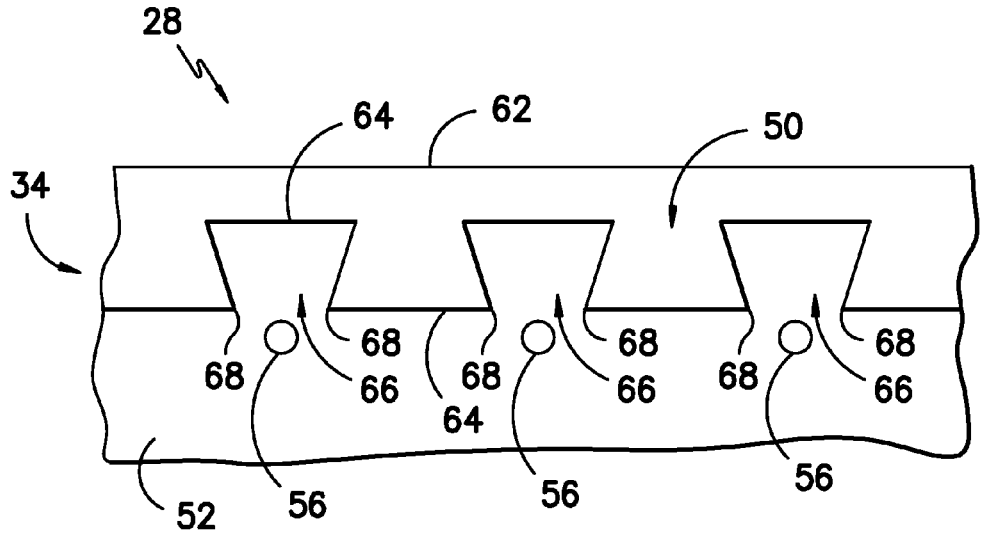
FIG. –6–

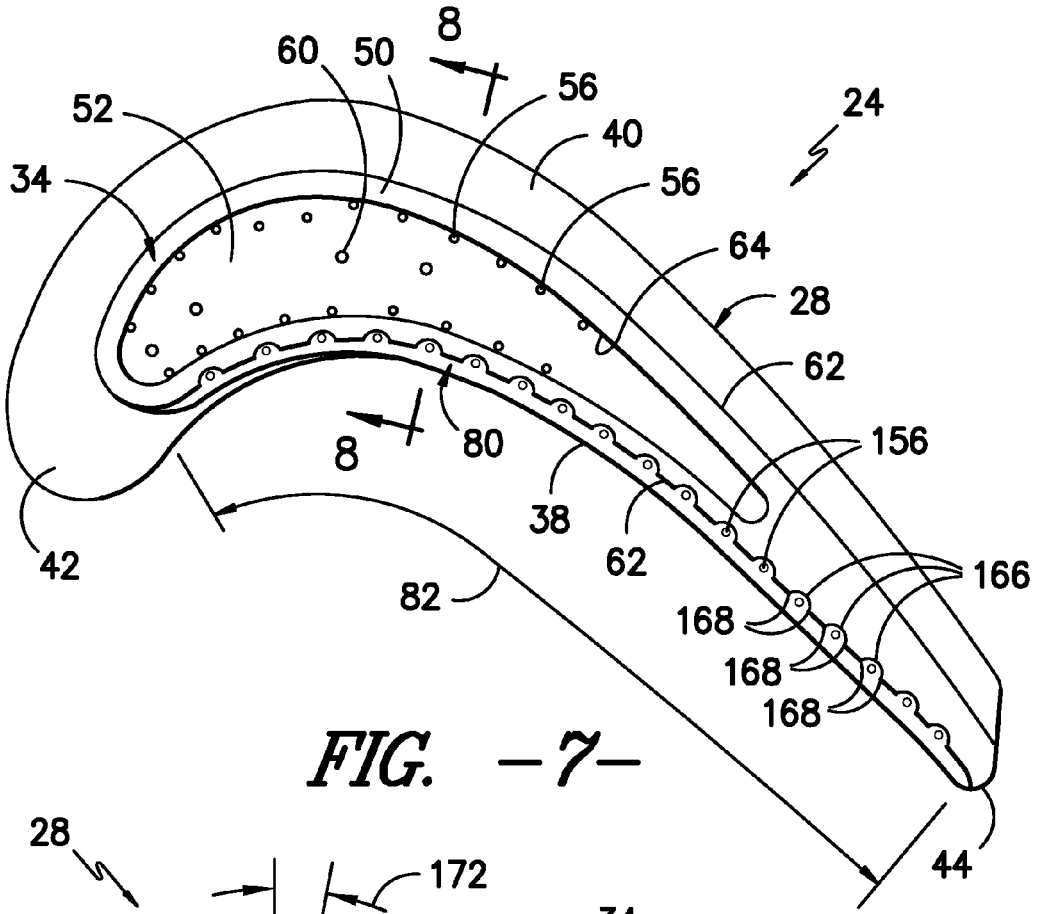
FIG. —7—
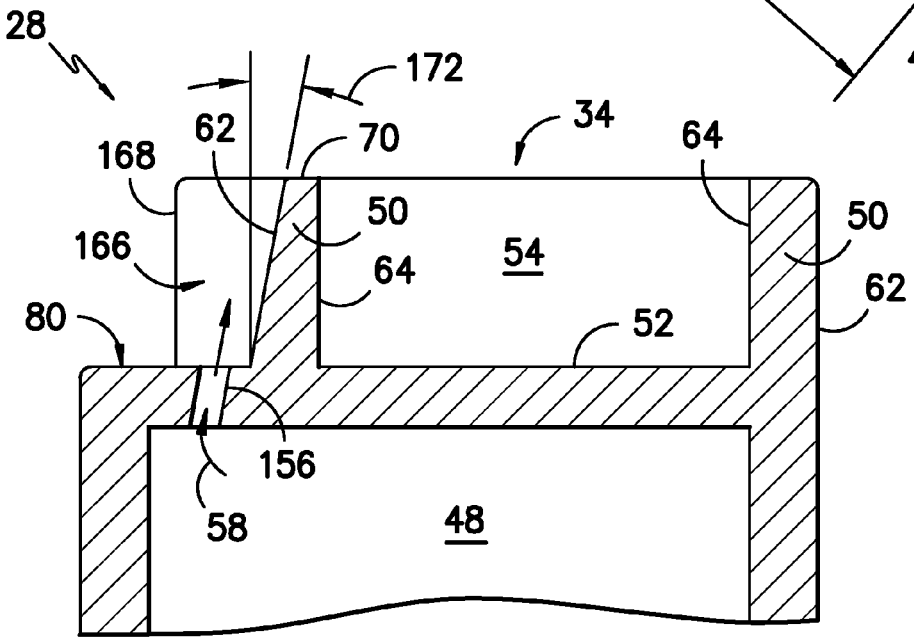
FIG. —8—

TURBINE BUCKET WITH NOTCHED SQUEALER TIP

FIELD OF THE INVENTION

The present subject matter relates generally to turbine buckets and, more particular, to a notched squealer tip for a turbine bucket.

BACKGROUND OF THE INVENTION

In an air-ingesting turbo machine (e.g., a gas turbine), air is pressurized by a compressor and then mixed with fuel and ignited within an annular array of combustors to generate hot gases of combustion. The hot gases flow from each combustor through a transition piece for flow along an annular hot gas path. Turbine stages are typically disposed along the hot gas path such that the hot gases flow through first-stage nozzles and buckets and through the nozzles and buckets of follow-on turbine stages. The turbine buckets may be secured to a plurality of rotor disks comprising the turbine rotor, with each rotor disk being mounted to the rotor shaft for rotation therewith.

A turbine bucket generally includes an airfoil extending radially outwardly from a substantially planar platform and a shank portion extending radially inwardly from the platform for securing the bucket to one of the rotor disks. The tip of the airfoil is typically spaced radially inwardly from a stationary shroud of the turbo machine such that a small gap is defined between the tip and the shroud. This gap is typically sized as small as practical to minimize the flow of hot gases between the airfoil tip and the shroud.

In many instances, the tip of the airfoil may include a squealer tip wall extending around the perimeter of the airfoil so as to define a tip cavity and a tip floor therebetween. The squealer tip wall is generally used to reduce the size of the gap defined between the airfoil tip and the shroud. However, this creates an additional component of the turbine bucket that is subject to heating by the hot gas flowing around the airfoil. Thus, cooling holes are typically defined in the tip floor to allow a cooling medium to be directed from an airfoil cooling circuit within the airfoil to the tip cavity.

Accordingly, an improved tip configuration that allows for enhanced cooling of an airfoil tip would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a turbine bucket including an airfoil. The airfoil may include a pressure side and a suction side extending between a leading edge and a trailing edge. In addition, the airfoil may include a tip. The tip may include a tip floor and a tip wall extending outwardly from the tip floor. The tip wall may include an inner surface defining an inner perimeter of the tip wall. Moreover, a plurality of notches may be defined by the inner surface around at least a portion of the inner perimeter.

In another aspect, the present subject matter is directed to a turbine bucket including an airfoil. The airfoil may include a pressure side and a suction side extending between a leading edge and a trailing edge. In addition, the airfoil may include a tip. The tip may include a tip floor and a tip wall extending outwardly from the tip floor. The tip wall may include an offset portion that is recessed relative to at least one of the pressure side or the suction side such that a tip shelf is defined at the offset portion. Moreover, a plurality of notches may be defined by the outer surface of the offset portion.

In a further aspect, the present subject matter is directed to a squealer tip for an airfoil. The squealer tip may include a tip floor and a tip wall extending outwardly from the tip floor along a pressure side and a suction side of the airfoil. The tip wall may include an inner surface defining an inner perimeter of the tip wall. In addition, a plurality of notches may be defined by the inner surface around at least a portion of the inner perimeter.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 illustrates a top view of the turbine bucket shown in FIG. 2, particularly illustrating an airfoil tip of the turbine bucket;

FIG. 4 illustrates a cross-sectional view of the airfoil tip shown in FIG. 3 taken along line 4-4;

FIG. 5 illustrates a top, partial view of one embodiment of an airfoil tip configuration, particularly illustrating a top view of a portion of a tip wall and a tip floor of the airfoil tip;

FIG. 6 illustrates a top, partial view of another embodiment of an airfoil tip configuration, particularly illustrating a top view of a portion of a tip wall and a tip floor of the airfoil tip;

FIG. 7 illustrates a top view of another embodiment of a turbine bucket having an airfoil tip in accordance with aspects of the present subject matter;

FIG. 8 illustrates a cross-sectional view of the airfoil tip shown in FIG. 7 taken along line 8-8.

DETAILED DESCRIPTION OF THE INVENTION

Figure 1:
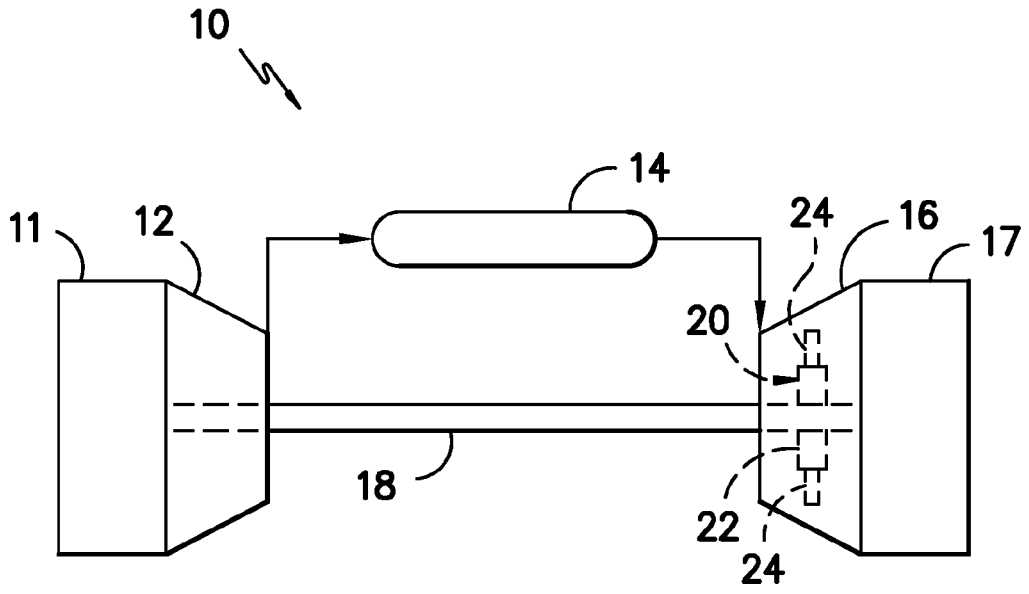
FIG. 1 illustrates a schematic diagram of one embodiment of a turbo machine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a turbine bucket having an improved squealer tip. Specifically, in several embodiments, the squealer tip may include a tip floor and a notched tip wall extending outwardly from the tip floor. For instance, in one embodiment, the inner surface of the tip wall may define a plurality of notches around the inner perimeter of the tip wall. Additionally, a plurality of cooling holes may be defined in the tip floor for supplying a cooling medium (e.g., air, water, steam) to the squealer tip. For example, the cooling holes may be defined in the tip floor so as to be aligned with the notches, such as by being positioned within the notches.

In alternative embodiments, the outer surface of the tip wall may define a plurality of notches. For instance, in several embodiments, a portion of the tip wall may be recessed such that a tip shelf is formed along the pressure side and/or suction side of the squealer tip. In such embodiments, the notches may be defined around the outer perimeter of the recessed portion of the tip wall. Additionally, a plurality of cooling holes may be defined in the tip shelf for supplying a cooling medium to the squealer tip.

It should be appreciated that numerous advantages may be provided by the disclosed notched tip wall. For example, the notches may provide an increased surface area for cooling the tip wall. In addition, the notches may also provide a means for forming angled cooling holes within the tip floor and/or the tip shelf. For instance, as will be described below, the notches may be angled relative to the tip floor and/or the tip shelf. As such, angled cooling holes may be formed within the notches without the need to use custom tooling and/or specialized manufacturing processes. Such angled cooling holes may allow for cooling medium to be diverted directly against the inner and/or outer surface of the tip wall, thereby providing enhanced cooling for the tip wall.

Referring now to the drawings, FIG. 1 illustrates a schematic diagram of one embodiment of an air-ingesting turbo machine 10. The turbo machine 10 generally includes an inlet section 11, a compressor section 12 disposed downstream of the inlet section 11, a plurality of combustors (not shown) within a combustor section 14 disposed downstream of the compressor section 12, a turbine section 16 disposed downstream of the combustor section 14 and an exhaust section 17 disposed downstream of the turbine section 16. Additionally, the turbo machine 10 may include a shaft 18 coupled between the compressor section 12 and the turbine section 16. The turbine section 16 may generally include a turbine rotor 20 having a plurality of rotor disks 22 (one of which is shown) and a plurality of turbine buckets 24 extending radially outwardly from and being coupled to each rotor disk 22 for rotation therewith. Each rotor disk 22 may, in turn, be coupled to a portion of the shaft 18 extending through the turbine section 16.

During operation of the turbo machine 10, the compressor section 12 pressurizes air entering the machine 10 through the inlet section 11 and supplies the pressurized air to the combustors of the combustor section 14. The pressurized air is mixed with fuel and burned within each combustor to produce hot gases of combustion. The hot gases of combustion flow in a hot gas path from the combustor section 14 to the turbine section 16, wherein energy is extracted from the hot gases by the turbine buckets 24. The energy extracted by the turbine buckets 24 is used to rotate the rotor disks 22 which may, in turn, rotate the shaft 18. The mechanical rotational energy may then be used to power the compressor section 12 and generate electricity. The hot gases exiting the turbine section 16 may then be exhausted from the machine 10 via the exhaust section 17.

Figure 2:
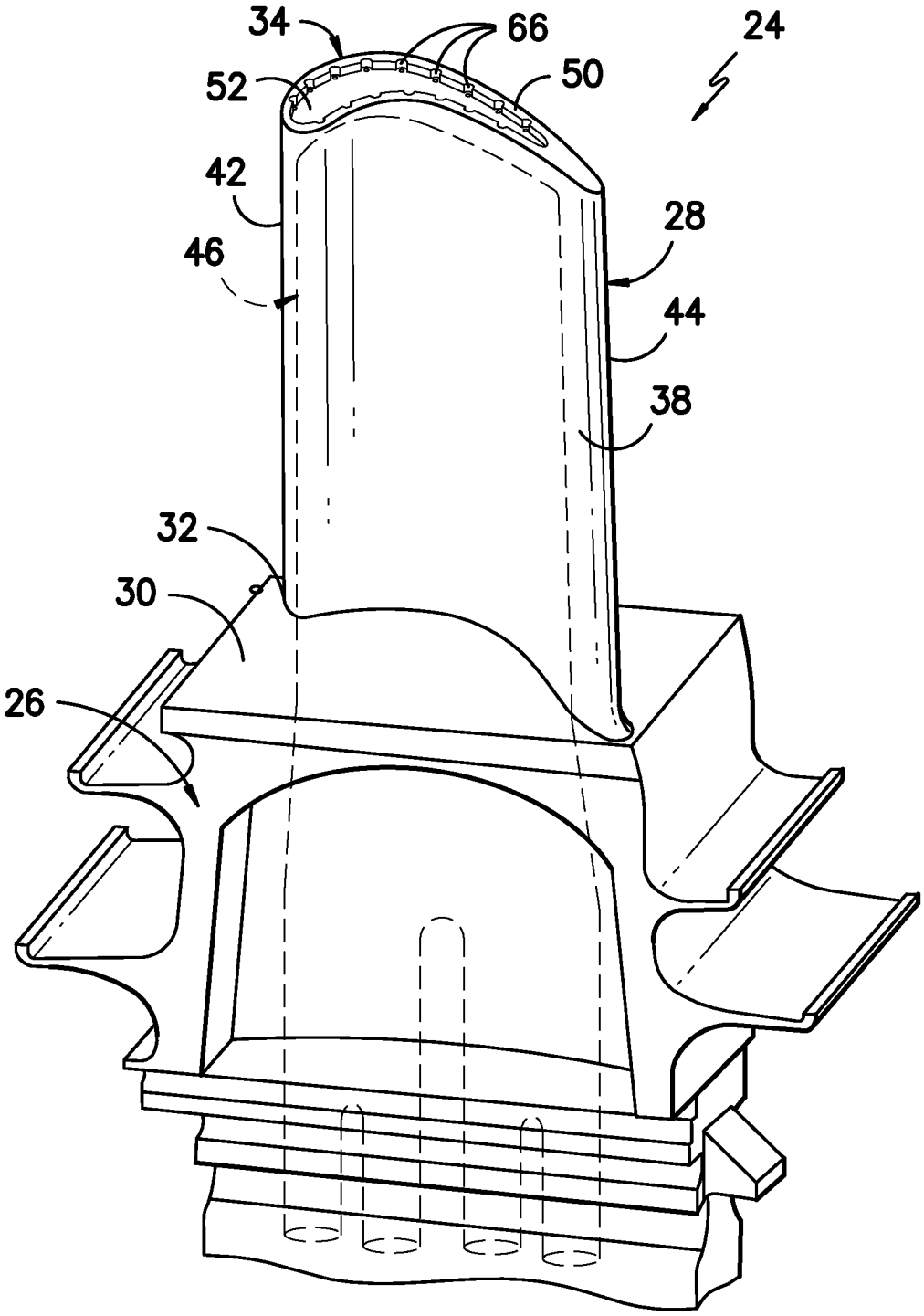
FIG. 2 illustrates a perspective view of one embodiment of a turbine bucket in accordance with aspects of the present subject matter.

Referring now to FIGS. 2-4, one embodiment of a turbine bucket 24 is illustrated in accordance with aspects of the present subject matter. In particular, FIG. 2 illustrates a perspective view of the turbine bucket 24. FIG. 3 illustrates a top view of the turbine bucket 24. Additionally, FIG. 4 illustrates a partial, cross-sectional view of the turbine bucket 24 taken along line 4-4 (FIG. 3).

As shown, the turbine bucket 24 generally includes a shank portion 26 and an airfoil 28 extending from a substantially planar platform 30. The platform 30 generally serves as the radially inward boundary for the hot gases of combustion flowing through the turbine section 16 of the turbo machine 10 (FIG. 1). The shank portion 26 may generally be configured to extend radially inwardly from the platform 30 and may include a root structure (not shown), such as a dovetail, configured to secure the bucket 24 to the rotor disk 22 of the turbo machine 10 (FIG. 1).

The airfoil 28 may generally extend radially outwardly from the platform 30 and may include an airfoil base 32 disposed at the platform 30 and an airfoil tip 34 disposed opposite the airfoil base 32. As such, the airfoil tip 34 may generally define the radially outermost portion of the turbine bucket 24 and, thus, may be configured to be positioned adjacent to a stationary shroud 36 (shown in dashed lines in FIG. 4) of the turbo machine 10. The airfoil 28 may also include a pressure side 38 and a suction side 40 (FIGS. 3 and 4) extending between a leading edge 42 and a trailing edge 44. The pressure side 38 may generally comprise an aerodynamic, concave outer surface of the airfoil 28. Similarly, the suction side 40 may generally define an aerodynamic, convex outer surface of the airfoil 28.

Additionally, the turbine bucket 24 may also include an airfoil cooling circuit 46 (shown in dashed lines in FIG. 2) extending radially outwardly from the shank portion 26 for flowing a cooling medium (e.g., air, water, steam or any other suitable fluid), throughout the airfoil 28. The airfoil circuit 46 may generally have any suitable configuration known in the art. Thus, in several embodiments, the airfoil circuit 46 may include a plurality of channels or passages 48 (one of which is shown in the cross-sectional view of FIG. 4) extending radially within the airfoil 28, such as from the airfoil base 32 to a location generally adjacent the airfoil tip 34. For example, in one embodiment, the airfoil circuit 46 may be configured as a multiple-pass cooling circuit, with the passages 48 being interconnected and extending radially inward and radially outward within the airfoil 28 (e.g., in a serpentine-like path) such that the cooling medium within the passages 48 flows alternately radially outwardly and radially inwardly throughout the airfoil 28.

Referring particularly to FIGS. 3 and 4, in several embodiments, the airfoil tip 34 may be configured as a squealer tip. As such, the airfoil tip 34 may include a tip wall 50 extending radially outwardly from a tip floor 52, thereby defining a squealer tip cavity 54 (FIG. 4). As particularly shown in FIG. 4, the tip floor 52 may generally define a radially outer boundary for cooling passages 48 of the airfoil circuit 46. In addition, the tip floor 52 may define a plurality of cooling holes 56 for directing the cooling medium (indicated by arrows 58) flowing within the cooling passages 48 into the tip cavity 54. For instance, as shown in FIGS. 3 and 4, the cooling holes 56 may be spaced apart along the tip floor 52 at locations generally adjacent to the pressure and suction sides of the tip wall 50. As such, the cooling medium 58 flowing through the cooling holes 56 may be directed around the inner perimeter of the tip wall to provide impingement and/or film cooling to the airfoil tip 34.

It should be appreciated one or more dust holes 60 may also be defined through the tip floor 52 for expelling dust and/or other debris contained within the cooling medium supplied through the airfoil circuit 46. For example, as shown in FIG. 3, the dust holes 60 may be defined in the tip floor 52 at a generally central location between the pressure and suction sides of the tip wall 50 so as to align the dust holes 60 with the cooling passages 48 of the airfoil circuit 46. As such, any dust and/or debris carried within cooling medium may be expelled from the cooling passages 48 through the dust holes 60.

The tip wall 50 of the airfoil tip 34 may generally be configured to for an extension of the airfoil 28. For example, as shown in FIG. 4, the tip wall 50 may be formed integrally with the airfoil 28 and may extend radially outwardly from the tip floor 52 along the pressure and suction sides 38, 40 of the airfoil 28. Additionally, as shown in FIG. 3, the tip wall 50 may generally extend between the leading and trailing edges 42, 44 of the airfoil 28 so as to define a continuous wall around the perimeter of the airfoil 28. As such, an outer surface 62 of the tip wall 50 (defining an outer perimeter of the tip wall 50) may generally form part of the pressure and suction sides 38, 40 of the airfoil 28 while an inner surface 64 of the tip wall 50 (defining an inner perimeter of the tip wall 50) may generally define the boundary of the tip cavity 54.

Additionally, in several embodiments, the tip wall 50 may be notched around at least a portion of its inner perimeter. Specifically, as shown in FIGS. 3 and 4, sections of the inner surface 64 may be configured to extend outwardly towards the outer surface 62 of the tip wall 50, thereby defining notches 66 in the inner perimeter of the tip wall 50 between opposed notch edges 68 of the inner surface 64. In several embodiments, the notches 66 may be defined around the inner perimeter of the tip wall 50 on both the pressure and suction sides 38, 40 of the airfoil 28. However, in other embodiments, the notches 66 may be defined may be defined around the inner perimeter of the tip wall 50 on only the pressure side 38 or the suction side 40 of the airfoil 28.

In general, the notches 66 may be formed in the tip wall 50 so as to define any suitable shape. For example, as shown in FIG. 3, the notches 66 may define a semi-elliptical shape (e.g. a semi-circular shape). Alternatively, as shown in FIG. 5, the notches may be formed in the tip wall 50 so as to define a rectangular shape (e.g., a square shape). In another embodiment, as shown in FIG. 6, the notches 66 may define a trapezoidal shape. In further embodiments, the notches 66 may define any other suitable shape, such as a triangular shape or any other suitable shape having straight and/or curved sides.

Additionally, as shown in FIG. 4, each notch 66 defined by the inner surface 64 may generally extend radially between the tip floor 52 and a top surface 70 of the tip wall 50. In one embodiment, the notches 66 may be configured to extend perpendicularly between the tip floor 52 and the top surface 70. Alternatively, the notches 66 may be configured to extend at an angle 72 between the tip floor 52 and the top surface 70. For instance, as shown in FIG. 4, the notches 66 may angled outwardly from the tip floor 52 in the direction of the outer surface 62 of the tip wall 50. It should be appreciated that the angle 72 defined by each notch 66 as it extends between the tip floor 52 and the top surface 70 of the tip wall 50 may generally be any suitable angle. However, in particular embodiment, the angle 72 may range from about 1 degree to about 30 degrees, such as from about 2 degrees to about 15 degrees or from about 2 degrees to about 20 degrees and all other subranges therebetween.

Moreover, in several embodiments, the cooling holes 56 defined in the tip floor 52 may be aligned with the notches 66 defined in the tip wall 50. For example, as shown in FIGS. 3 and 4, in one embodiment, the cooling holes 56 may be defined in the tip floor 52 so as to be positioned within the notches 66. As described herein, a cooling hole 56 is positioned within a notch 66 if at least a portion of an outlet 74 of the cooling hole 56 is disposed in the area defined by such notch 66 (i.e., the area defined between the notch edges 68 of each notch 66). For example, as shown in FIG. 4, the outlets 74 of the cooling holes 56 are disposed inside the notch edges 68 and, thus, are positioned within the notches 66.

In other embodiments, the cooling holes 56 may be defined in the tip floor 52 at any other suitable position relative to the notches 66. For example, the cooling holes 56 may be defined in the tip floor 52 so as to be positioned outside the notches 66 (i.e., at a location outside the area defined between the notch edges 68 the notches 66). Specifically, as shown in FIG. 5, in one embodiment, the cooling holes 56 may be defined in the tip floor 52 so as to be positioned between the notches 66 (e.g., by positioning each cooling hole 56 between the notch edges 68 of adjacent notches 66). Alternatively, as shown in FIG. 6, the cooling holes 56 may be defined in the tip floor 52 so as to be aligned with the notches 66 at locations outside the notch edges 68. In addition, it should be appreciated that the cooling holes 56 may be positioned both inside and outside the notches 66. For example, as shown in FIG. 5, a first portion of the cooling holes 56 may be defined in the tip floor 52 so as to be positioned within the notches 66 while a second portion of the cooling holes may be defined in the tip floor 52 so as to be positioned between the notches 66.

Additionally, in several embodiments, the cooling holes 56 may be oriented perpendicularly or non-perpendicularly within the tip floor 52. Specifically, in one embodiment, the cooling holes 56 may be angled relative to the tip wall 50. For instance, as shown in FIG. 4, the cooling holes 56 may be angled towards the tip wall 50 (e.g., at the same or a different angle as the angle 72 of the notches 66) such that the cooling medium 58 supplied through the cooling holes 56 is directed against the inner surface 64 of the tip wall 50, thereby providing beneficial cooling to the tip wall 50. However, in other embodiments, the cooling holes 56 may be defined perpendicularly within the tip floor 52 and, thus, may extend generally parallel to the tip wall 50.

It should be appreciated that, by angling the notches 66 as described above, the angled cooling holes 56 shown in FIG. 5 may be quickly and easily formed within the tip floor 52. For instance, by appropriately angling the notches 66, angled cooling holes 56 may be drilled or otherwise formed in the tip floor 52 using standard equipment and/or processes (e.g., a straight drill bit).

Referring now to FIGS. 7 and 8, another embodiment of airfoil tip configuration is illustrated in accordance with aspects of the present subject matter. In particular, FIG. 7 illustrates a top view of one embodiment of an airfoil 28 of a turbine bucket 24, particularly illustrating the airfoil 28 including a tip shelf 80 defined at the airfoil tip 34. In addition, FIG. 8 illustrates a partial, cross-sectional view of the airfoil 28 shown in FIG. 7 about line 8-8.

As shown, the tip wall 50 may include an offset portion 82 that is recessed relative to the pressure and/or suction sides 38, 40 of the airfoil 28, thereby forming a tip shelf 80 adjacent to such offset portion 82. For example, as shown in FIGS. 7 and 8, the offset portion 82 of the tip wall 50 may be positioned on the pressure side 38 of the airfoil 28 such that the tip shelf 80 forms an extension of the tip floor 52 along the pressure side 38. However, in other embodiments, the offset portion 82 of the tip wall 50 may be positioned on the suction side 40 of the airfoil 28 such that the tip shelf 80 forms an extension of the tip floor 52 along the suction side 40.

In several embodiments, when a tip shelf 80 is formed in the airfoil tip 34, the outer perimeter of the tip wall 50 may be notched around the portion of the tip wall 50 defined by the offset portion 82. Specifically, as shown in FIGS. 7 and 8, sections of the outer surface 62 of the tip wall 50 forming the offset portion 82 may be configured to extend inwardly towards the inner surface 64 of the tip wall 50, thereby defining notches 166 in the outer perimeter of the tip wall 50 between opposed notch edges 168 of the outer surface 64. In general, the notches 166 formed around the outer perimeter of the tip wall 50 may be configured the same as or similar to the notches 66 described above with reference to FIGS. 2-6. For example, the notches 166 may be configured to define any suitable shape (e.g., a semi-elliptical shape, a rectangular shape, a trapezoidal shape, a triangular shape and/or any other suitable shape). Additionally, in several embodiments, the notches 166 may be configured to extend at an angle 172 between the tip floor 52 and the top surface 70 of the tip wall 50.

Moreover, a plurality of cooling holes 156 may also be defined in the tip shelf 80 for directing a cooling medium (indicated by arrows 58) from the passages 48 of the airfoil cooling circuit 46 to the offset portion 82 of the tip wall 50. For example, as shown in FIG. 8, the cooling holes 56 may be defined through the tip shelf 80 such that at least a portion of the cooling medium 58 flowing within the airfoil 28 may be directed around the outer perimeter of the tip wall 50. In general, the cooling holes 156 defined in the tip shelf 80 may be configured the same as or similar to the cooling holes 56 described above with reference to FIGS. 2-6. For instance, in several embodiments, the cooling holes 156 may be aligned with the notches 166 defined in the tip wall 50, such as by being positioned within the notches 166 (e.g., by defining the cooling holes 156 within the area defined between the notch edges 168 of each notch 166). Alternatively, the cooling holes 156 may be defined in the tip shelf 80 so as to be positioned between the notches 166. Additionally, in several embodiments, the cooling holes 156 may be oriented non-perpendicularly within the tip floor 52. For instance, as shown in FIG. 8, the cooling holes 156 may be angled towards the tip wall 50 (e.g., at the same or a different angle as the angle 172 of the notches 166) such that the cooling medium 58 supplied through the cooling holes 156 is directed against the outer surface 62 of the tip wall 50, thereby providing beneficial cooling to the tip wall 50.

It should be appreciated that, in additional embodiments of the present subject matter, the disclosed notches 66, 166 may be formed around portions of both the inner and outer perimeters of the tip wall 50. For example, in the embodiment shown in FIGS. 7 and 8, in addition to the notches 166 defined by the outer surface 62 of the tip wall 50, a plurality of notches 66 may also be defined by the inner surface 64 of the tip wall as shown in FIGS. 2-6.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbine bucket comprising:

an airfoil including a pressure side and a suction side extending between a leading edge and a trailing edge, the airfoil further including a tip, the tip comprising:

a tip floor; and a tip wall extending outwardly from the tip floor, the tip wall including an offset portion that is recessed relative to at least one of the pressure side or the suction side such that a tip shelf is defined at the offset portion, the offset portion of the tip wall defining an outer surface, wherein a plurality of notches are defined by the outer surface of the offset portion of the tip wall, each of the plurality of notches being defined between opposed notch edges of the outer surface and extending radially between the tip shelf and a top surface of the tip wall, wherein a plurality of cooling holes are defined in the tip shelf, a first cooling hole of the plurality of cooling holes being aligned with a first notch of the plurality of notches, the first cooling hole defining an outlet at the tip shelf for directing a cooling medium from an internal cooling circuit of the airfoil to an exterior of the airfoil, wherein the first cooling hole extends lengthwise between the internal cooling circuit and the tip shelf such that the first cooling hole is angled towards the outer surface of the offset portion of the tip wall.

2. The turbine bucket of claim 1, wherein the offset portion of the tip wall is disposed on the pressure side of the airfoil.

3. The turbine bucket of claim 1, wherein each of the plurality of notches extends at an angle along the outer surface of the offset portion of the tip wall between the tip floor and the top surface of the tip wall.

4. The turbine bucket of claim 3, wherein the angle ranges from 1 degree to 30 degrees.

5. The turbine bucket of claim 3, wherein the outer surface of the offset portion of the tip wall and the first cooling hole are angled in the same direction.

6. The turbine bucket of claim 1, wherein at least one cooling hole of the plurality of cooling holes is defined in the tip shelf so as to be positioned between two notches of the plurality of notches.

7. The turbine bucket of claim 1, wherein the outlet of the first cooling hole defines a dimensional parameter that is smaller than an area defined between the opposed notch edges of the first notch.

8. The turbine bucket of claim 7, wherein the outlet of the first cooling hole is spaced apart from the first notch along the tip shelf such that portions of the tip shelf extend outwardly from the outlet around an entire perimeter of the outlet.

9. The turbine bucket of claim 7, wherein the dimensional parameter corresponds to a cross-sectional area of the outlet at the tip shelf.

10. The turbine bucket of claim 7, wherein the outlet of the first cooling hole is positioned entirely within the area defined between the opposed notch edges of the first notch.

11. The turbine bucket of claim 10, wherein the area is defined between the opposed notch edges at a radial location at which the first notch intersects the top surface of the tip wall.

12. The turbine bucket of claim 7, wherein the outlet of the first cooling hole is positioned entirely outside the area defined between the opposed notch edges of the first notch.

13. A squealer tip for an airfoil, the squealer tip comprising:

a tip floor; and a tip wall extending outwardly from the tip floor, the tip wall including an offset portion that is recessed relative to at least one of the pressure side or the suction side such that a tip shelf is defined at the offset portion, the offset portion of the tip wall defining an outer surface, wherein a plurality of notches are defined by the outer surface of the offset portion of the tip wall, each of the plurality of notches being defined between opposed notch edges of the outer surface and extending radially between the tip shelf and a top surface of the tip wall, wherein a plurality of cooling holes are defined in the tip shelf, a first cooling hole of the plurality of cooling holes being aligned with a first notch of the plurality of notches, the first cooling hole defining an outlet at the tip shelf for directing a cooling medium from an internal cooling circuit of the airfoil to an exterior of the airfoil, wherein the first cooling hole extends lengthwise between the internal cooling circuit and the tip shelf such that the first cooling hole is angled towards the outer surface of the offset portion of the tip wall.

14. The squealer tip of claim 13, wherein each of the plurality of notches extends at an angle along the outer surface of the offset portion of the tip wall between the tip floor and the top surface of the tip wall.

15. The squealer tip of claim 14, wherein the angle ranges from 1 degree to 30 degrees.

16. The squealer tip of claim 14, wherein the outer surface of the outer portion of the tip wall and the first cooling hole are angled in the same direction.

17. The squealer tip of claim 13, wherein the outlet of the first cooling hole defines a dimensional parameter that is smaller than an area defined between the opposed notch edges of the first notch.

18. The squealer tip of claim 17, wherein the outlet of the first cooling hole is spaced apart from the first notch along the tip shelf such that portions of the tip shelf extend outwardly from the outlet around an entire perimeter of the outlet.

19. The squealer tip of claim 13, wherein the outlet of the first cooling hole is positioned entirely within or entirely outside the area defined between the opposed notch edges of the first notch.

20. The squealer tip of claim 19, wherein the outlet of the first cooling hole is positioned entirely within the area defined between the opposed notch edges of the first notch, the area being defined between the opposed notch edges at a radial location at which the first notch intersects the top surface of the tip wall.

* * * * *